US011161368B2

(12) United States Patent
Cubillo

(10) Patent No.: US 11,161,368 B2
(45) **Date of Patent: *Nov. 2, 2021**

(54) TOOL BOX USEFUL FOR PAINTERS

(71) Applicant: Juan Cubillo, Midland Park, NJ (US)

(72) Inventor: Juan Cubillo, Midland Park, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/681,268

(22) Filed: Nov. 12, 2019

(65) Prior Publication Data

US 2020/0079139 A1 Mar. 12, 2020

Related U.S. Application Data

(63) Continuation of application No. 16/145,124, filed on Sep. 27, 2018, now Pat. No. 10,513,143, which is a continuation of application No. 15/664,488, filed on Jul. 31, 2017, now abandoned.

(60) Provisional application No. 62/368,349, filed on Jul. 29, 2016.

(51) Int. Cl.

| | |
|---|---|
| ***B44D 3/12*** | (2006.01) |
| ***B65D 25/28*** | (2006.01) |
| ***B65D 25/04*** | (2006.01) |
| ***B65D 25/10*** | (2006.01) |

(52) U.S. Cl.

CPC ..... *B44D 3/125* (2013.01); *B65D 25/04* (2013.01); *B65D 25/10* (2013.01); *B65D 25/2823* (2013.01)

(58) Field of Classification Search

CPC ..... B44D 3/125; B44D 3/123; B65D 25/10; B65D 25/04; B65D 25/2823

USPC ..... 206/361, 362, 349, 207, 209, 209.1; 211/182, 153, 184

See application file for complete search history.

(56) References Cited

U.S. PATENT DOCUMENTS

| | | | | |
|---|---|---|---|---|
| 407,524 | A * | 7/1889 | Hall | B44D 3/125 206/209 |
| 2,043,643 | A * | 6/1936 | Yenne | B44D 3/125 15/104.92 |
| 2,469,749 | A * | 5/1949 | Spangler | B44D 3/125 206/362 |
| 2,555,810 | A * | 6/1951 | Parsons | B44D 3/125 248/110 |
| 2,646,808 | A * | 7/1953 | Yenne | B44D 3/121 15/104.92 |
| 5,641,007 | A * | 6/1997 | Falk | B44D 3/125 141/106 |
| 2007/0045132 | A1* | 3/2007 | Anderson | B44D 3/125 206/209 |

* cited by examiner

*Primary Examiner* — Rafael A Ortiz

(74) *Attorney, Agent, or Firm* — Hoffmann & Baron, LLP

(57) ABSTRACT

The invention provides an improved tool box useful for painters featuring a first receiving space or compartment, a second receiving space or compartment, a handle or means for carrying or transporting the tool box, and a means for receiving or holding in a substantially vertical position a paint brush or paint roller or tool useful for a painter. The tool box may be formed of any suitable material or combination or materials such as wood, fiber board, pressboard, rubber, plastic, metal or cardboard. The tool box may be designed for extended life or it may be formed of one or more materials adapted to be disposed of after one or a few or several uses. The tool box may be of any suitable shape such as substantially rectangular, square, oblong, elliptical, round, etc.

9 Claims, 6 Drawing Sheets

TOOL BOX USEFUL FOR PAINTERS

CROSS-REFERENCE TO RELATED APPLICATION

This application is a continuation of U.S. application Ser. No. 16/145,124 filed on Sep. 27, 2018, which is a continuation of U.S. application Ser. No. 15/664,488 filed on Jul. 31, 2017, which is abandoned, which claims priority to U.S. Provisional Patent Application No. 62/368,349 filed on Jul. 29, 2016, the entire contents of which are herein incorporated by reference in their entirety.

FIELD OF THE INVENTION

This invention relates to an improved tool box having an apparatus or assembly affixed thereto or contained therein useful for holding and transporting paint brushes, paint rollers and other tools useful for painters.

BACKGROUND OF THE INVENTION

King, U.S. Pat. No. 4,746,042 describes a portable paint brush holder (or holster). The paint brush holder has means (such as a clip, loops, a stud and loop and the like) for attaching the brush holder to a belt of the painter and is a substantially rectangular container having a top opening to hold the paint brush in a upright position with the handle of the brush pointing up. The portable paint brush holder holds the wet paint brush securely, prevents paint drips and prevents drying of the paint on the brush. The portable paint brush holder also includes a kit comprising the portable paint brush holder which is detachably engaged to the belt of the painter and a clip for permanent attaching to the flat portion of the paint brush at the bristle-handle interface. The clip on the brush aids in securing the paint brush within the paint brush holder reservoir.

Robinson, U.S. Pat. No. 5,489,051 describes a gravity responsive apparatus for carrying paint and painters' tools suspended on the hip of a painter that features a hip-supported, belt-attached base member which is flexibly attached by means of a separable ball and socket joint to a freely swinging sealable paint container and fitted tool carrier. The device allows a painter to more easily and safely climb ladders and scaffolds without spilling paint. A painter may open and fold back the hinged cover to access the paint and useful tools. Multiple tools may be carried in the integral tool rack which is a part of the apparatus. The freely swinging construction allows the painter to assume various positions without spilling paint or dropping tools. The device is made of a smooth, seamless material, is readily cleanable and requires little care or maintenance.

Darling, U.S. Pat. No. 5,695,104 describes a painter's accessory holder for holding painting tools such as a caulking gun, sandpaper, glazing compound and a bladed tool on a base member that is attachable to a belt worn by the painter. The accessory holder includes a caulking gun bracket attached to the base member configured to accept a caulking gun, the caulking gun finger guard engaging a portion of the bracket to securely hold the caulking gun in place, while at the same time rendering it easily removable. A sandpaper bracket is attached to the base member to clamp sandpaper between the bracket and the base so as to be securely but removably held and readily accessible to the painter. The device also may include a pouch attached to the base member to hold a glazing compound and a bladed tool bracket to hold bladed tools, such as putty knives, etc. The bladed tool bracket may be formed by a generally "U" shaped metal bracket which allows the handle of the bladed tool to pass through, but engages the blade portion so as to securely, but removably hold the bladed tool. The bladed tool bracket may also be formed by a strip of material which also allows the handle to pass through, but engages the blade portion.

It would be useful and desirable to provide a tool box useful for painters for transporting multiple tools and paints useful for painting, and for transporting paint brushes, rollers, and other applicators whether dry or wet. All publications, patent applications, patents and other reference material mentioned are incorporated by reference in their entirety. In addition, the materials, methods and examples are only illustrative and are not intended to be limiting. The citation of references herein is not to be construed as an admission that the references are prior art to the present invention.

SUMMARY OF THE INVENTION

The invention provides a tool box useful for painters comprising at least one first receiving space or compartment, at least one second receiving space or compartment, a handle or means for carrying or transporting the tool box, and a means for receiving or holding in a substantially vertical position, a paint brush or paint roller or tool useful for a painter. The tool box may be formed of any suitable material or combination or materials such as wood, fiber board, pressboard, rubber, plastic, metal or cardboard. The tool box may be designed for extended life or it may be formed of one or more materials adapted to be disposed of after one or a few or several uses. The tool box may be of any suitable shape such as substantially rectangular, square, oblong, elliptical, round, etc. Similarly, it may be of any suitable size such as, for instance, about 1, 2, 3, 4, or 5 or more feet long, about 1, 2, 3, 4, or 5 or more feet wide, and about 6", 12", 18", 24", 30", or 36" or more, tall.

The first receiving space or compartment may as desired occupy, for instance, a half or two thirds or even three fourths or more of the area or of the cubic volume of the tool box, and it may be substantially enclosed on three or four sides, for instance, leaving a top surface open. In particular, the first receiving space or compartment comprises a floor and three or four vertical walls, which walls are contiguous and connected along adjacent vertical edges. The first receiving space may optionally be covered on all sides, so that for instance, the top surface may be covered by a solid or semi-solid flap or lid, not shown, that may be movable or may be removable with respect to the remainder of the tool box. The flap or lid may be optionally fastened or locked to the remainder of the tool box with any suitable fastener or locking mechanism.

The second receiving space or compartment may as desired occupy, for instance, a fourth, a third, or a half or more of the area or of the cubic volume of the tool box, and it may be substantially enclosed on three or four sides, for instance, leaving a top surface open. The second receiving space may optionally be covered on all sides, for instance, the top surface covered by a rigid or flexible flap or lid, not shown, that may be movable or may be removable with respect to the remainder of the tool box. The flap or lid may be optionally fastened or locked to the remainder of the tool box with any suitable fastener or locking mechanism.

In an alternate, particular embodiment of the invention, illustrated in FIG. 5 and discussed later on herein, the tool box may comprise plural second receiving spaces or compartments 2. In turn, the second receiving spaces or compartments 2 may located laterally flanking and on opposite sides of the first receiving space or compartment 1.

The handle or means for carrying or transporting the tool box 3 may extend across the top of the first receiving space or compartment, across the top of the second receiving space or compartment, or across the top of both the first and the second receiving spaces or compartments. The handle or means for carrying or transporting the tool box may be formed of any suitable material or combination or materials such as wood, fiber board, pressboard, rubber, plastic, metal or cardboard. The handle or means for carrying or transporting the tool box may be of any suitable shape such as substantially rectangular, oblong, etc. and may form a substantial bar. Similarly, it may be of any suitable size such as, for instance, about 0.5", 1", 2", 3", 4", or 5" or more in diameter and about 1, 2, 3, 4, or 5 or more feet long.

The means for receiving or holding in a substantially vertical position a paint brush or paint roller or tool useful for a painter, referred to hereinafter and alternately, as the receiving or holding means, may extend across the top of the first receiving space or compartment, across the top of the second receiving space or compartment, or across the top of both the first and the second receiving spaces or compartments. The receiving or holding means may comprise at least one rod, bar or like support 13, that is mounted and suspended in a horizontal position, by and between opposed vertical walls of the second receiving space or compartment. As illustrated for example in FIG. 1, plural receiving or holding means are provided and mounted.

The receiving or holding means 4 may be formed of any suitable material or combination or materials such as wood, fiber board, pressboard, rubber, plastic, metal or cardboard. The receiving or holding means may be of any suitable shape such as substantially rectangular, oblong, etc. and may form a substantial bar. Similarly, it may be of any suitable size such as, for instance, about 0.1", 0.25", 0.5", 0.75", or 1" or more in diameter and about 6", 12", 18", 24", 30", or 36" or more long.

The receiving or holding means 4 is preferably removable and suitable for positioning through a hole or aperture that may be found in the handle of a paint brush or paint roller or tool useful for a painter. The receiving or holding means 4 may be positioned through a hole or aperture 5 in the wall of the first or the second receiving space or compartment. There may be a stopping means 6 provided on one side of the receiving or holding means to prevent movement through the first or the second receiving space or compartment so that the receiving or holding means remains substantially stationary once in place. The stopping means may be, for instance, a washer or bolt attached thereto, or a knob as illustrated in FIGS. 6-8.

In an alternate embodiment shown in FIG. 9, the receiving or holding means 4 may comprise a rod 13 that defines an enlarged diameter end 14 that releasably engages and is captured by a corresponding clasp or catch 15 that is located in an indent 16 within the second or end guard 12 that is in turn, fastened or otherwise engages the adjacent wall of the second receiving space or compartment 2 that is distal to first receiving space or compartment 1, so that the enlarged diameter end and the clasp or catch, in combination with the knob at the opposite end of the rod, comprise the stopping means 6. Further detail as to the structure and operation of the rod, its enlarged end, the catch or clasp and the second or end guard means is presented hereinbelow with reference to FIG. 9.

Accordingly, it is a principal object of the present invention to provide a tool box that is suitable for painters, and that enables the convenient transport of a plurality of painters' supplies and tools, including paint brushes, whether they are wet or dry.

It is a further object of the present invention to provide a tool box that can be adjusted in its size of compartments to accommodate different quantities of supplies and tools.

Other objects and advantages will become apparent to those skilled in the art from a review of the ensuing description which proceeds with reference to the following illustrative drawings.

DETAILED DESCRIPTION OF THE PREFERRED EMBODIMENTS

In accordance with the present invention, the foregoing objects and advantages are readily attained.

Figure 1:
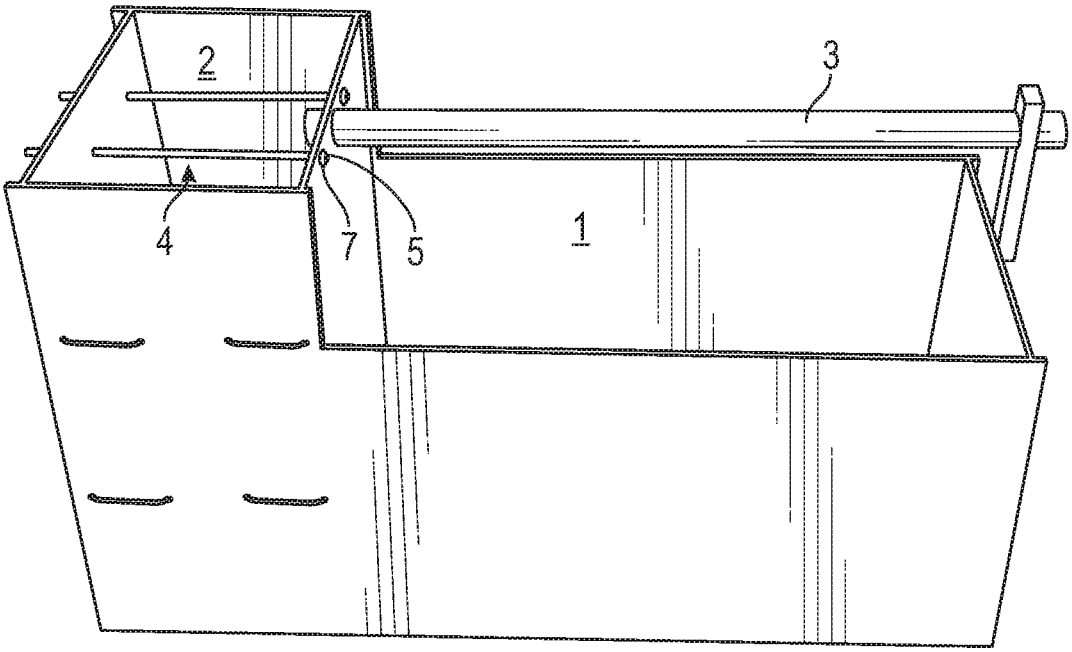
FIG. 1 is a perspective view depicting the length dimension and a portion of the interior of the tool box of the invention including the first receiving space or compartment 1, the second receiving space or compartment 2, a handle or means for carrying or transporting the tool box 3, and receiving or holding means 4 as described herein. The receiving or holding means 4 as shown is positioned through a hole or aperture 5 in the wall that as illustrated, is located between and thus defines both the first receiving space or compartment 1 and the second receiving space or compartment 2. A stopping means 6 is provided on one side of the receiving or holding means 4, and a guard means 7 is provided around the hole or aperture 5.

Referring to the figures wherein like numerals denote like parts, and particularly to FIG. 1, a tool box useful for painters is shown that comprises a first receiving space or compartment 1, a second receiving space or compartment 2, a handle or means for carrying or transporting the tool box 3, and a receiving or holding means 4. Two receiving or holding means 4 are depicted, and are positioned through individual, spaced apart holes or apertures 5 in the wall of the first receiving space or compartment 1 or the second receiving space or compartment 2. A stopping means 6 is provided on one side of the receiving or holding means 4. The stopping means 6 may be a bolt or washer affixed to the receiving or holding means 4. Advantageously, a guard means 7 may be provided to secure or preserve the hole or aperture 5 in the wall of the first receiving space or compartment 1 or the second receiving space or compartment 2.

Figure 2:
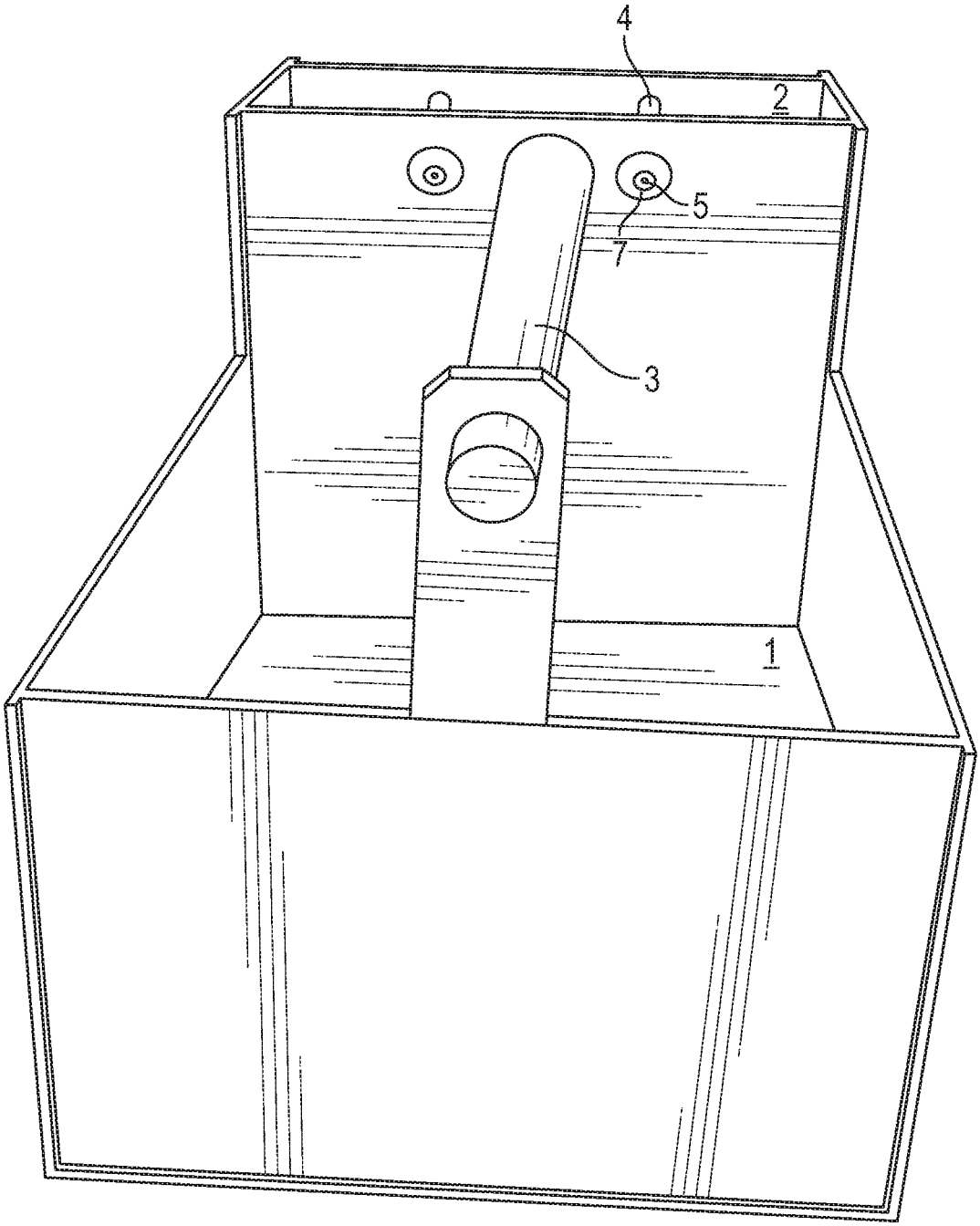
FIG. 2 is a perspective view like FIG. 1, taken from the right end of the tool box shown in FIG. 1, that illustrates the first receiving space or compartment 1, the second receiving space or compartment 2, the wall defining and dividing compartments 1 and 2, a handle or means for carrying or transporting the tool box 3, and plural receiving or holding means 4 as described herein. The receiving or holding means 4 are positioned through holes or apertures 5 in the wall, and guard means 7 are provided around each hole or aperture 5.

Referring to FIG. 2, a tool box useful for painters featuring a first receiving space or compartment 1, a second receiving space or compartment 2, a handle or means for carrying or transporting the tool box 3, and receiving or holding means 4 is provided. The receiving or holding means 4 is positioned through a hole or aperture 5 in the wall of the first receiving space or compartment 1 or the second receiving space or compartment 2.

Figure 3:
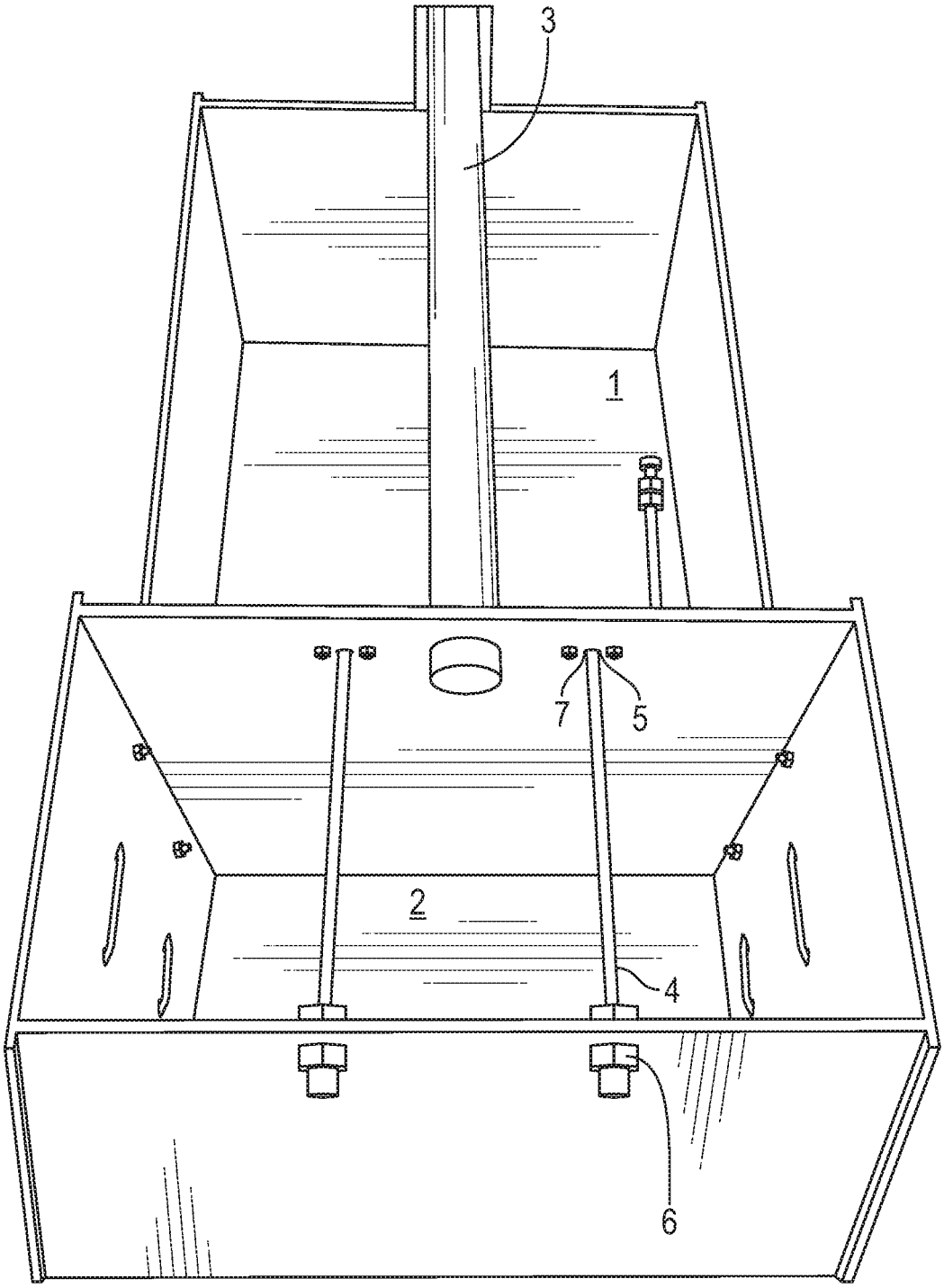
FIG. 3 is a top view depicting a tool box useful for painters featuring a first receiving space or compartment 1, a second receiving space or compartment 2, a handle or means for carrying or transporting the tool box 3, and receiving or holding means 4 as described herein. The receiving or holding means 4 is positioned through a hole or aperture 5 in the wall of the first receiving space or compartment 1 or the second receiving space or compartment 2. A stopping means 6 is provided on one side of the receiving or holding means 4. A guard means 7 is provided around the hole or aperture 5.

Referring to FIG. 3, a tool box useful for painters featuring a first receiving space or compartment 1, a second receiving space or compartment 2, a handle or means for carrying or transporting the tool box 3, and receiving or holding means 4 is provided. Receiving or holding means 4 is positioned through a hole or aperture 5 in the wall of the first receiving space or compartment 1 or the second receiving space or compartment 2. A stopping means 6 is provided on one side of the receiving or holding means 4. Advantageously, a guard means 7 may be provided to secure or preserve the hole or aperture 5 in the wall of the first receiving space or compartment 1 or the second receiving space or compartment 2.

The receiving or holding means 4 as described herein may be adapted to be removable from the remaining components of the tool box described herein, either entirely or in part. As such, receiving or holding means 4 in use may be passed through an opening, aperture or hole, not shown, in, for instance, a handle of a paint brush or a paint roller or a tool useful for a painter. Exemplary tools useful for a painter may be, for instance, a scraper, a leveler, a spatula, a container for holding paint, screws, nails, and the like, a hammer, a screw driver, a wrench, pliers, and the like. By holding a paint brush or a paint roller or a tool useful for a painter in a vertical position, it may be possible or prevent cross contamination with paint or with a fluid useful for removing or diluting paint, and it may be possible to facilitate or expedite drying of the paint brush or paint roller or tool useful for a painter. Likewise, the support or suspension of the painter's equipment or supplies by the receiving or holding means 4 offers easy access to such equipment or supplies by the painter during work.

Figure 4:
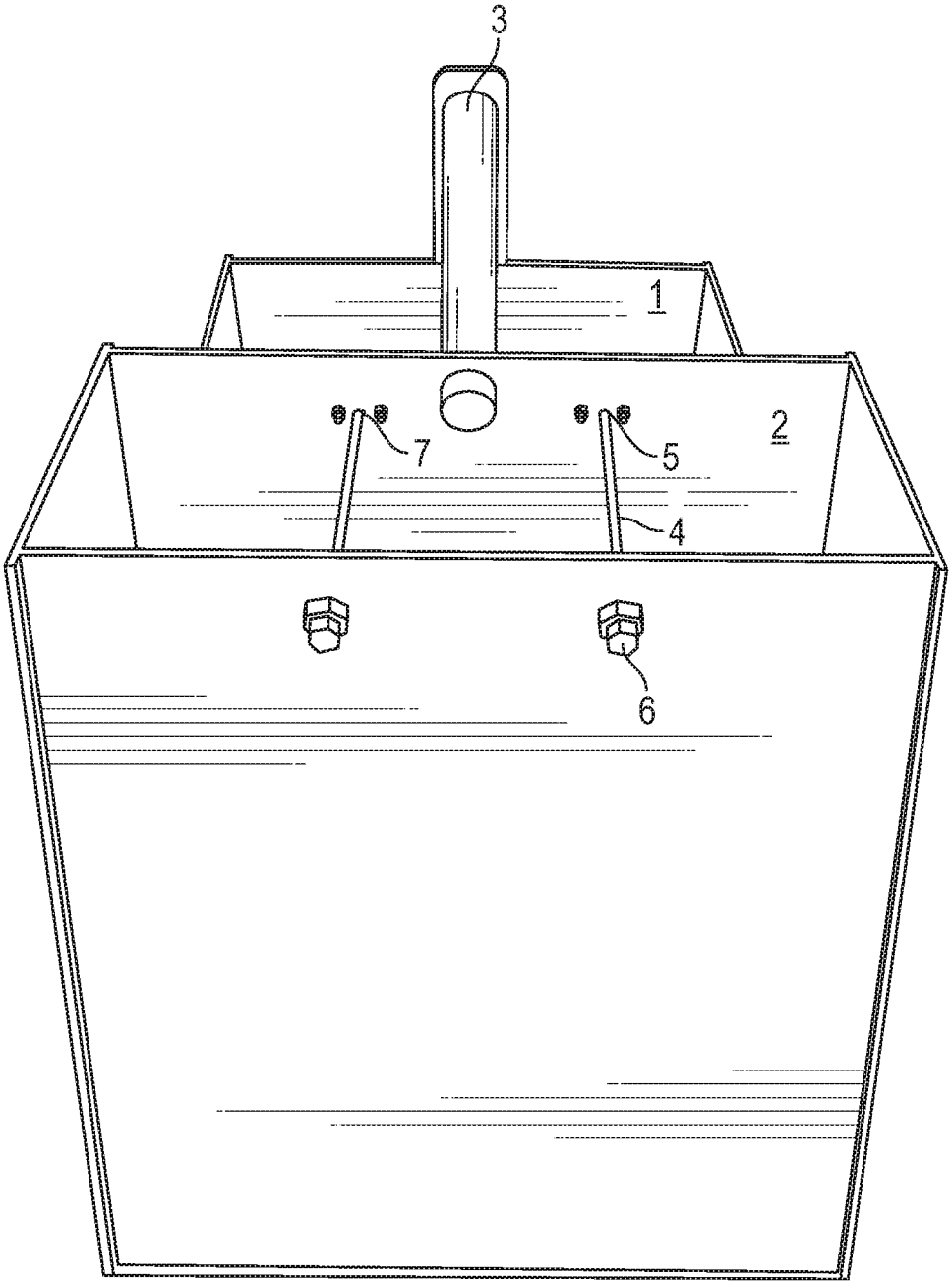
FIG. 4 is a top perspective view depicting a tool box useful for painters featuring a first receiving space or compartment 1, a second receiving space or compartment 2, a handle or means for carrying or transporting the tool box 3, and a receiving or holding means 4 as described herein. The receiving or holding means 4 is positioned through a hole or aperture 5 in the wall of the first or the second receiving space or compartment 2. A stopping means 6 is provided on one side of the receiving or holding means 4. A guard means 7 is provided around the hole or aperture 5.

Referring to FIG. 4, a tool box useful for painters featuring a first receiving space or compartment, a second receiving space or compartment, a handle or means for carrying or transporting the tool box, and a means for receiving or holding a paint brush or paint roller or tool useful for a painter, in a substantially vertical position 4 is provided. The receiving or holding means 4 is positioned through a hole or aperture 5 in the wall of the first or the second receiving space or compartment 2. A stopping means 6 is provided on one side of receiving or holding means 4. Advantageously, a guard means 7 is provided to secure or preserve the hole or aperture 5 in the wall of the first or the second receiving space or compartment 2.

Figure 5:
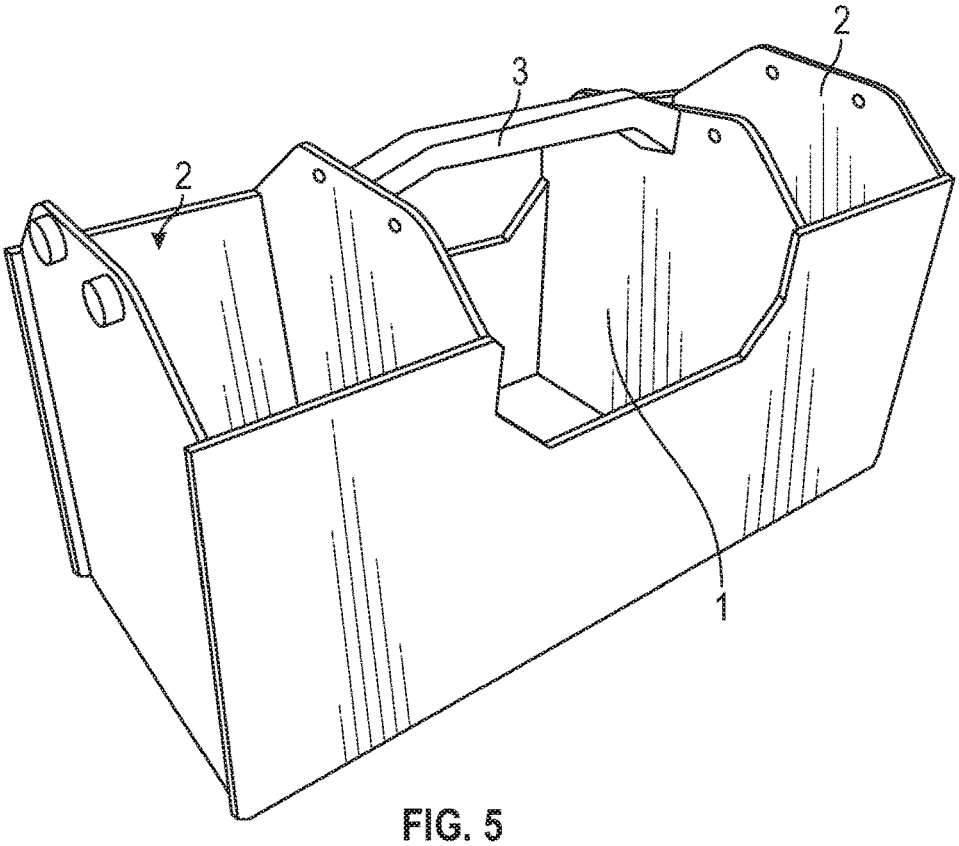
FIG. 5 is perspective view similar to FIG. 1 showing the top, a broad side and an end view of a tool box in accordance with an alternate embodiment of the invention. In this embodiment plural second receiving spaces or compartments 2 are present and are located laterally adjacent opposite sides of the first space or compartment 1. The handle or means for carrying or transporting the tool box 3 extends across first receiving space or compartment 1 and is fastened to the opposed walls that divide compartment 1 from adjacent compartments 2.

Referring now to FIG. 5, a tool box is shown that is constructed in accordance with an alternate embodiment. In this embodiment plural second receiving spaces or compartments 2 are present and are located laterally adjacent opposite sides of the first space or compartment 1. The handle or means for carrying or transporting the tool box 3 extends across first receiving space or compartment 1 and is fastened to the opposed walls that divide compartment 1 from adjacent compartments 2. Also, each of compartments 2 are adapted to contain receiving or holding means 4, not shown, that are disposed and supported by opposed wall of the compartments. This configuration facilitates the balancing of the load in the instance where the tools or equipment outweigh the remaining supplies contained in centrally located compartment 1.

Figure 6:
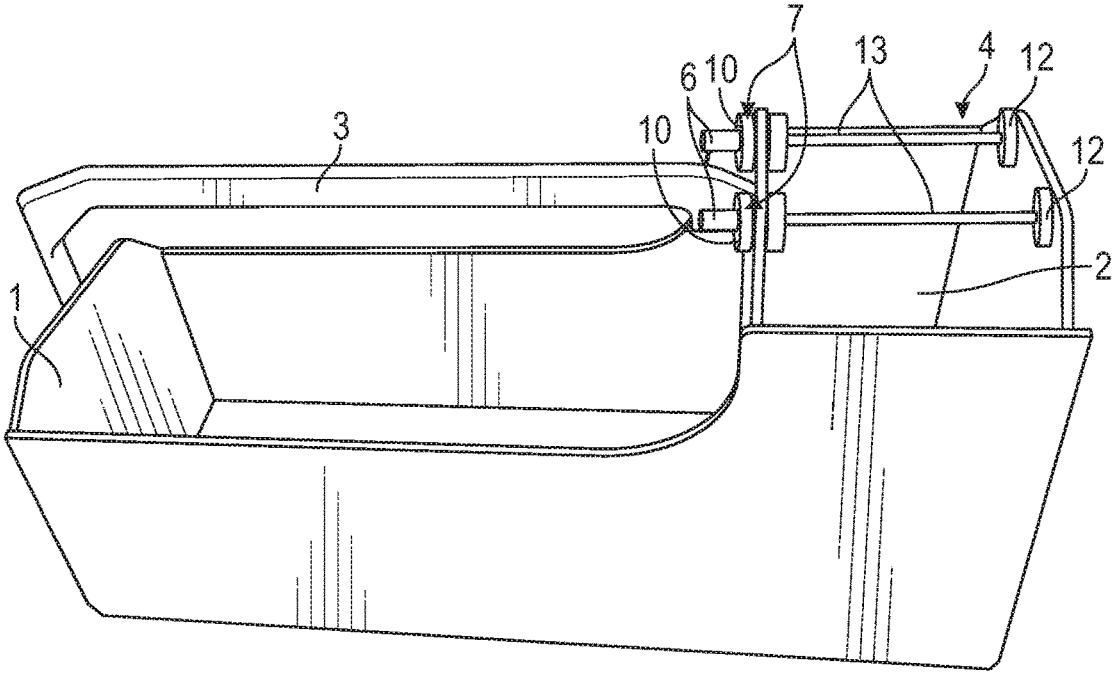
FIG. 6 is a perspective view of a tool box similar to that shown in FIG. 1 depicting release or holding means 4 in accordance with an alternate embodiment.

Referring now to FIG. 6, a tool box in accordance with a further alternate embodiment to that of FIG. 1 is shown. The tool box illustrated herein contains a release or holding means 4 that is fitted with a rod, stopping means and guard means that are different and modular in design, although performing the same functions as with the constructions presented in FIGS. 1-4. Also, the handle 3 differs from the design and construction of FIGS. 1-4, as it is streamlined and offers a continuous, unitary appearance.

Figure 7:
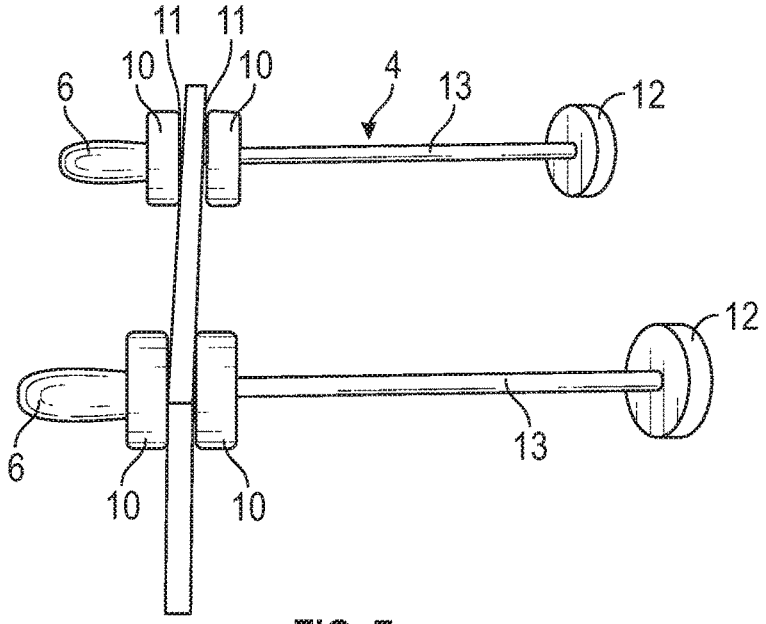
FIGS. 7 and 8 are perspective views depicting the release or holding means 4 of FIG. 6 in greater detail.

Referring to FIG. 7, a tool box having the release or holding means 4 of FIG. 6 is shown in greater detail. In this embodiment, release or holding means 4 comprises a rod 13 which defines on its proximal end a stopping means 6 that may comprise a knob as shown. On the opposite or distal end, release or holding means 4 defines an enlarged diameter element 14 that is adapted for releasable engagement within a corresponding catch or clasp means 15 affixed to the wall of compartment 2 that is juxtaposed to the wall bearing hole or aperture 5. In use, the painter withdraws the release or holding means 4 from its engagement with the catch or clasp means 15 by pulling on stopping means 6, and thereby accesses the supplies or equipment that are desired for use. Conversely, once the desired equipment or tools are accessed and removed from the tool box, stopping means 6 on rod 13 of release or holding means 4 is thrust forward and so that rod 13 engages the catch or clasp means 15, to secure the remaining supplies or equipment suspended on the release or holding means 4.

Figure 8:
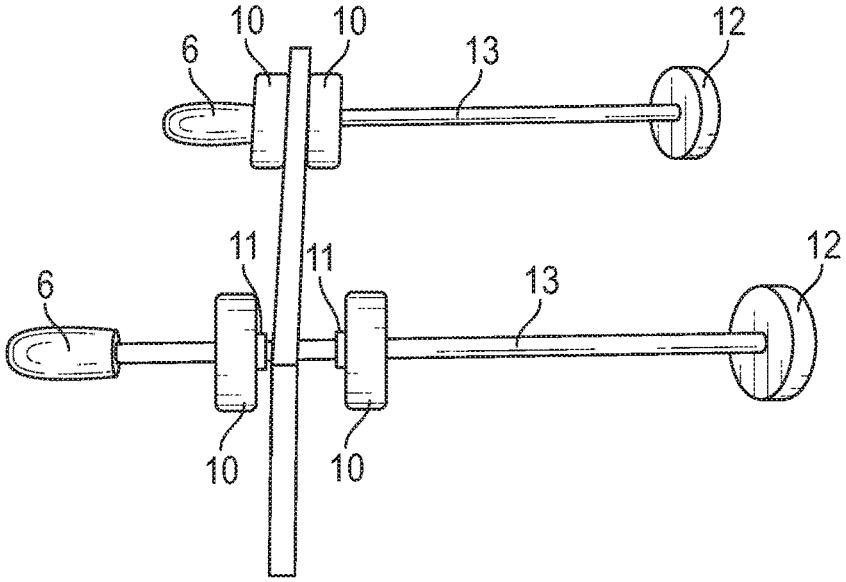
Figure 9:
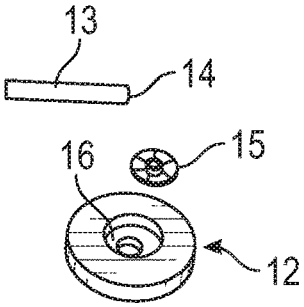
FIG. 9 is a fragmentary view of the release or holding means 4 showing the rod 13 and the enlarged distal end 14, the catch or clasp 15 and the indent 16 within the second support means 12 that houses and secures the catch or clasp in place in the assembled tool box.

Referring now to FIG. 8, a guard means 7 is shown in detail, that offers greater stability and useful life in conjunction with the release or holding means 4. In particular, guard means 7 comprises paired first supports 10 that are positioned on opposite sides of the wall containing aperture 5 and are in registry therewith. In turn, paired supports 10 define one or more cylindrical bearing structures 11 therewithin, that provide a stable race for the axial reciprocation of the rods of the release or holding means 4 therethrough. It should be noted that the guard means of the invention contemplates and includes the use of a single bearing structure that would extend through the wall containing aperture 5, and that would be held in place by the paired supports 10 placed on either side of the wall and fastened or otherwise engaged therewith.

Referring further to FIG. 8, guard means 7 also includes second supports 12 that may comprise a flat member like that of first supports 10. Second supports 12 are located at the terminal end of travel of the rods 13 of the release or holding means 4, and are affixed or otherwise attached to the distal wall of the second compartment 2. Second supports 12 house and retain catches or clasps 15 within a generally cylindrical cutout 16. As discussed earlier, the painter withdraws rod 13 of release or holding means 4 out of engagement with catch or clasp 15 to access the tools or supplies suspended on rod 13. Conversely, the painter thrusts the rod 13 forward so that the increased diameter end 14 engages the catch or clasp means 15 and thereby locks the release or holding means 4 securely in position within second compartment 2 so that the remaining tools and equipment are securely suspended therefrom.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

The invention claimed is:

1. A tool box comprising:

a receiving space or compartment having a dividing wall, the dividing wall having at least one aperture;

at least one holder for hanging tool, the holder including a rod; and a guard comprising paired first supports and a second support, the paired supports positioned on each of opposite sides of the dividing wall around the at least one aperture and the second support attached to a wall opposite to the dividing wall, wherein each of the paired first supports define at least one bearing structure therewithin to provide a stability for an axial reciprocation of the rod.

2. The tool box according to claim 1, wherein the tool box is substantially rectangular in shape.

3. The tool box according to claim 1, wherein the holder, for hanging the tool, extends across a top of the first receiving space or compartment, across a portion of a top of the receiving space or compartment.

4. The tool box according to claim 3, wherein the holder, for hanging the tool, is disposed in a generally horizontal position with respect to said tool box.

5. The tool box according to claim 1, wherein the holder, for hanging the tool, is removable.

6. The tool box according to claim 1, wherein the holder, for hanging the tool, is positioned through the at least one aperture in the dividing wall.

7. The tool box according to claim 1, wherein the at least one aperture in the dividing wall is suitable for passing the holder for hanging the tool therethrough.

8. A tool box comprising:

a receiving space or compartment having a dividing wall, the dividing wall having at least one aperture;

at least one holder for hanging tool, the holder including a rod; and a guard comprising paired first supports and a second support, the paired supports positioned on each of opposite sides of the dividing wall around the at least one aperture and the second support attached to a wall opposite to the dividing wall, wherein the rod defines a stopper on a proximal end of the rod and an enlarged element on a distal end of the rod, the distal end of the rod is dimensioned to be inserted into the at least one aperture, and wherein the stopper is a washer or bolt.

9. A tool box comprising:

a receiving space or compartment having a dividing wall, the dividing wall having at least one aperture;

at least one holder for hanging tool, the holder including a rod; and a guard comprising paired first supports and a second support, the paired supports positioned on each of opposite sides of the dividing wall around the at least one aperture and the second support attached to a wall opposite to the dividing wall, wherein the second support includes a clasp that is retained within a cylindrical cutout defined on the second support.

* * * * *